US012799826B2

(12) United States Patent
Lin et al.

(10) Patent No.: US 12,799,826 B2
(45) Date of Patent: Nov. 17, 2026

(54) GEOSTEERING METHOD AND APPARATUS, AND STORAGE MEDIUM

(71) Applicants: China National Petroleum Corporation, Beijing (CN); CNPC Engineering Technology R & D Company Limited, Beijing (CN)

(72) Inventors: Wang Lin, Beijing (CN); Dong Wu, Beijing (CN); Hongzhi Xue, Beijing (CN); Weixing Zhu, Beijing (CN)

(73) Assignees: CHINA NATIONAL PETROLEUM CORPORATION, Beijing (CN); CNPC ENGINEERING TECHNOLOGY R & D COMPANY LIMITED, Beijing (CN)

( * ) Notice: Subject to any disclaimer, the term of this patent is extended or adjusted under 35 U.S.C. 154(b) by 215 days.

(21) Appl. No.: 18/907,064

(22) Filed: Oct. 4, 2024

(65) Prior Publication Data

US 2025/0027370 A1 Jan. 23, 2025

Related U.S. Application Data

(63) Continuation of application No. PCT/CN2023/095140, filed on May 18, 2023.

(30) Foreign Application Priority Data

Jun. 8, 2022 (CN) ..... 202210638287.5

(51) Int. Cl.
*E21B 7/06* (2006.01)
*E21B 47/022* (2012.01)
*E21B 47/026* (2006.01)

(52) U.S. Cl.
CPC ..... *E21B 7/06* (2013.01); *E21B 47/022* (2013.01); *E21B 47/026* (2013.01)

(58) Field of Classification Search
None
See application file for complete search history.

(56) References Cited

U.S. PATENT DOCUMENTS

2018/0334896 A1 11/2018 Samuel et al.
2020/0109618 A1 4/2020 Flanagan et al.
2020/0248545 A1 8/2020 Maus et al.

FOREIGN PATENT DOCUMENTS

CN 103046868 A 4/2013
CN 106894761 A 6/2017
(Continued)

OTHER PUBLICATIONS

Notice of Grant of Invention Patent Rights issued in related Chinese Application No. 202210638287.5, issued on Aug. 14, 2023 in 5 pages.

(Continued)

*Primary Examiner* — Sean Shechtman
(74) *Attorney, Agent, or Firm* — Davis Wright Tremaine LLP

(57) ABSTRACT

A geosteering method and apparatus, and a storage medium, where the method includes: acquiring first well trajectory information of a target well, and first geological information and second geological information of the target well; determining, by using a plane where a first well trajectory is located as a steering profile, a geological structure line of a first class geological layer corresponding to the first geological information on the steering profile, and determining, by using the geological structure line of the first class geological layer as a reference and based on the second geological information, a geological structure line of a second class geological layer corresponding to the second geological information on the steering profile, so as to obtain a geosteering model of the target well; and using the (Continued)

geosteering model to perform geosteering on actual drilling of the target well.

19 Claims, 6 Drawing Sheets

(56) References Cited

FOREIGN PATENT DOCUMENTS

| | | | |
|---|---|---|---|
| CN | 106940450 | A | 7/2017 |
| CN | 108008469 | A | 5/2018 |
| CN | 108442882 | A | 8/2018 |
| CN | 108625782 | A | 10/2018 |
| CN | 109138837 | A | 1/2019 |
| CN | 109557584 | A | 4/2019 |
| CN | 113536574 | A | 10/2021 |
| CN | 113743175 | A | 12/2021 |
| CN | 114970182 | A | 8/2022 |
| RU | 2720115 | C1 | 4/2020 |
| WO | 2021256950 | A1 | 12/2021 |

OTHER PUBLICATIONS

Chinese Office Action issued in related Chinese Application No. 202210638287.5, issued on Jun. 3, 2023, in 7 pages.

International Search Report issued in related PCT Application No. PCT/CN2023/095140, mailed on Jun. 23, 2023, in 13 pages.

Yinsen Miao, et al., Nonlinear state-space modeling approaches to real-time autonomous geosteering, Journal of Petroleum Science and Engineering, Feb. 5, 2020, in 13 pages. Houston, USA.

Zha Shugui, et al., Seismic geo-steering technology of horizontal well and its application in fuling shale gas field, Geophysical Prospecting for Petroleum, May 2018, in 9 pages, vol. 57, No. 3.

4a

4b

GEOSTEERING METHOD AND APPARATUS, AND STORAGE MEDIUM

CROSS-REFERENCE TO RELATED APPLICATIONS

The present application is a continuation of International Application No. PCT/CN2023/095140, filed on May 18, 2023, which claims priority to Chinese Patent Application No. 202210638287.5, filed on Jun. 8, 2022, and entitled "GEOSTEERING METHOD AND APPARATUS, AND STORAGE MEDIUM." The above applications are hereby incorporated by reference in their entireties.

TECHNICAL FIELD

The present application relates to the technical field of oil and gas reservoir exploitation and, in particular, to a geosteering method and apparatus, and a storage medium.

BACKGROUND

In an exploitation of a complex oil and gas reservoir, an oil and gas reservoir exploitation efficiency of a horizontal well of the oil and gas reservoir is in direct proportion to a reservoir penetration rate of the horizontal well, and the reservoir penetration rate refers to the probability of encountering a target geological layer that stores oil or gas during an actual drilling process of the horizontal well. Providing an accurate geosteering in actual drilling process of the horizontal well may ensure that the horizontal well has a high reservoir penetration rate. The geosteering refers to a measurement control technology that adjusts a wellbore trajectory in real time during the drilling process of the horizontal well according to various geological information, logging-while-drilling and measurement data.

Current geosteering methods mainly include the following two stages: a first stage, in which a geosteering model is established based on geological information of a reference well of a target well; and a second stage, in which the established geosteering model is used to perform geosteering on actual drilling process of the target well, and specifically, during the actual drilling process, the geosteering model is used for actual drilling analysis, and a designed well trajectory of the target well is adjusted in real time based on a result of the actual drilling analysis, so as to obtain an adjusted well trajectory which is used for drilling control during the drilling process. For example, if the result of the actual drilling analysis shows that a drilling trajectory deviates from the target geological layer, the designed well trajectory will be adjusted so as to achieve adjustment and control of a subsequent drilling trajectory, thereby ensuring that the target well has a high reservoir penetration rate. The designed well trajectory is a wellbore trajectory designed for the target well in advance based on the geological information of the reference well of the target well. In the present application, the designed well trajectory is also referred to as the first well trajectory.

The existing geosteering methods have a problem of inaccurate steering, resulting in a low reservoir penetration rate of the target well, which cannot meet subsequent oil and gas reservoir exploitation efficiency requirements of the target well.

SUMMARY

The present application provides a geosteering method and apparatus, and a storage medium, so as to solve the problem of inaccurate steering in the existing geosteering methods.

In a first aspect, the present application provides a geosteering method, including:

acquiring first well trajectory information of a target well, and first geological information and second geological information of the target well, where the first geological information is geological information obtained by investigating a geology of a first designated geological attribute in a region corresponding to the first well trajectory, the first geological information includes interface coordinate information of a geological layer of at least one geological attribute, and the second geological information includes interface coordinate information of geological layers of each geological attribute of a reference well of the target well;

determining, by using a plane where the first well trajectory is located as a steering profile, a geological structure line of a first class geological layer corresponding to the first geological information on the steering profile, and determining, by using the geological structure line of the first class geological layer as a reference and based on the second geological information, a geological structure line of a second class geological layer corresponding to the second geological information on the steering profile, so as to obtain a geosteering model of the target well, where the geological structure lines are intersecting lines between interfaces of the geological layers and the steering profile, and the second class geological layer refers to a geological layer with a geological attribute that is different from that of the first class geological layer; and using the geosteering model to perform geosteering on actual drilling of the target well.

In an embodiment, the first geological information is geological information on a first designated geological attribute obtained through seismic inversion and/or sedimentary facies research;

the determining, by using the plane where the first well trajectory is located as the steering profile, the geological structure line of the first class geological layer corresponding to the first geological information on the steering profile, includes:

creating the steering profile along the first well trajectory, where a length of the steering profile is not less than a true horizontal length (THL) of the first well trajectory, and a height of the steering profile is not less than a maximum value of a total thickness of geological layers with a second designated geological attribute in the region corresponding to the first well trajectory; and determining the geological structure line of the first class geological layer corresponding to the first geological information of the first designated geological attribute on the steering profile.

In an embodiment, the determining, by using the geological structure line of the first class geological layer as the reference and based on the second geological information, the geological structure line of the second class geological layer corresponding to the second geological information on the steering profile, includes:

determining, based on an arrangement order of the second class geological layer in the second geological information and using the geological structure line of the first class geological layer as a reference, the geological structure line of the second class geological layer that is co-interfaced with the first class geological layer, in a manner that is equal in thickness to the second class geological layer in the second geological information; and determining the geological structure line of the second class geological layer that is not co-interfaced with the first class geological layer, according to an arrangement order of the second class geological layer in the second geological information and in a manner of equal thickness ratio.

In an embodiment, the using the geosteering model to perform geosteering on the actual drilling of the target well, includes:

reviewing and adjusting the first well trajectory by the geosteering model so as to obtain a second well trajectory, where all horizontal well segments of the second well trajectory are in contact with a target geological layer; and performing geosteering on the actual drilling of the target well based on the geosteering model and the second well trajectory.

In an embodiment, the reference well of the target well is determined as follows:

if the number of an adjacent well adjacent to the target well in a designated region is less than or equal to one, the adjacent well and/or a pilot well of the target well is determined as the reference well;

if the number of the adjacent well adjacent to the target well in the designated region is greater than one and there is a geological fault between the adjacent wells, the first well trajectory is segmented by using an intersection point between the geological fault or a plane where the geological fault is located and the first well trajectory as a segmentation node so as to obtain first well trajectory segments; and the adjacent well located on the same side of the geological fault as each of the first well trajectory segments is determined as the reference well of each of the first well trajectory segments; and if the number of the adjacent well adjacent to the target well in the designated region is greater than one and there is no geological fault between the adjacent wells, the first well trajectory is segmented by using an intersection point between a perpendicular line from the adjacent well to the first well trajectory and the first well trajectory as a segmentation node so as to obtain first well trajectory segments; and the adjacent well corresponding to the segmentation node on the first well trajectory segments is determined as the reference well.

In an embodiment, after determining the adjacent well corresponding to the segmentation node on the first well trajectory segments as the reference well, the method further includes:

if there are two segmentation nodes on the first well trajectory segments, dividing the first well trajectory segments into two node sub-segments and one transition sub-segment according to a pre-set threshold value, where the node sub-segment is a sub-segment including the segmentation node, and the transition sub-segment is a sub-segment connected to the two node sub-segments respectively;

determining, by using the geological structure line corresponding to the first geological information as a reference and based on the second geological information that the adjacent well corresponding to the segmentation node on the node sub-segment is the reference well, the geological structure line of the second class geological layer corresponding to the node sub-segment; and performing a smooth processing on the geological structure line of each node sub-segment corresponding to the transition sub-segment so as to obtain the geological structure line of the second class geological layer corresponding to the transition sub-segment.

In an embodiment, the determining, by using the plane where the first well trajectory is located as the steering profile, the geological structure line of the first class geological layer corresponding to the first geological information on the steering profile, further includes:

if the first well trajectory intersects with the geological fault, segmenting the first well trajectory by using the intersection point between the first well trajectory and the geological fault as the segmentation node so as to obtain the first well trajectory segments; and determining, with a plane where the first well trajectory segments are located as the steering profile and based on the first geological information corresponding to the first well trajectory segments, the geological structure line of the first class geological layer corresponding to the first geological information corresponding to the first well trajectory segments on the steering profile corresponding to the first well trajectory segments.

In a second aspect, the present application provides a geosteering modeling device, including: a transceiving module, a modeling module, and a steering module; where the transceiving module is configured to acquire first well trajectory information of a target well, and first geological information and second geological information of the target well, where the first geological information is geological information obtained by investigating a geology of a first designated geological attribute in a region corresponding to the first well trajectory, the first geological information includes interface coordinate information of a geological layer of at least one geological attribute, and the second geological information includes interface coordinate information of a geological layer of each geological attribute of a reference well of the target well;

the modeling module is configured to determine, with a plane where a first well trajectory is located as a steering profile, a geological structure line of a first class geological layer corresponding to the first geological information on the steering profile, and to determine, by using the geological structure line of the first class geological layer as a reference and based on the second geological information, a geological structure line of a second class geological layer corresponding to the second geological information on the steering profile, so as to obtain a geosteering model of the target well, where the geological structure line is an intersecting line between an interface the geological layer and the steering profile, and the second class geological layer refers to the geological layer with a geological attribute that is different from that of the first class geological layer; and the steering module is configured to use the geosteering model to perform geosteering on actual drilling of the target well.

In a third aspect, the present application provides a geosteering modeling apparatus, where the apparatus includes:

a processor and a memory; where the memory stores executable instructions that may be executed by the processor; and the processor executes the executable instructions stored in the memory, so that the processor executes the method as described above.

In a fourth aspect, the present application provides a storage medium, where the storage medium stores computer-executable instructions which, when executed by a processor, are used to implement the method as described above.

In a fifth aspect, the present application provides a program product, including a computer program which, when executed by a processor, implements the method as described above.

In the geosteering method and apparatus, and the storage medium provided in the present application, the geological structure line of the first class geological layer corresponding to the first geological information on the steering profile is determined by using the plane where the first well trajectory of the target well is located as the steering profile and based on the first geological information, and consequently, the geological structure line of the geological layer of the first designated geological attribute in the region corresponding to the first well trajectory on the steering profile is determined; and then the geological structure line of the second class geological layer on the steering profile is determined by using the geological structure line of the first class geological layer as a reference and in conjunction with the second geological information, and thus an accurate geosteering model of the target well is formed. The accurate geosteering model is used to perform precise geosteering on the actual drilling of the target well so as to ensure that the target well has a high reservoir penetration rate. The present application solves the problem of inaccurate steering in the existing geosteering methods.

BRIEF DESCRIPTION OF THE DRAWINGS

The accompanying drawings herein, which are incorporated into the specification and form a part of the specification, illustrates the embodiments in accordance with the present application and are used together with the specification to explain the principles of the present application.

Through the above accompanying drawings, specific embodiments of the present application have been illustrated, and more detailed descriptions will be provided in the following. The accompanying drawings and the textual description are not intended to limit the scope of the present application in any way, but are used to illustrate the concepts of the present application for those skilled in the art by referring to the specific embodiments.

DESCRIPTION OF EMBODIMENTS

To make the objectives, technical solutions, and advantages of the embodiments of the present application clearer, the following will provide a clear and complete description of the technical solutions in the embodiments of the present application in conjunction with the accompanying drawings. Obviously, the described embodiments are merely some rather than all of the embodiments of the present disclosure. Based on the embodiments in the present application, all other embodiments obtained by those ordinary skilled in the art without creative efforts should fall within the protection scope of the present application.

With the gradual reduction of conventional oil and gas resources, the petroleum industry is increasingly focusing on the exploitation of complex oil and gas reservoirs. The complex oil and gas reservoirs may be, for example, thin oil and gas reservoirs, fractured oil and gas reservoirs, etc. The complex oil and gas reservoirs have the characteristics of rapid geological structural change and high reservoir non-uniformity. At present, the complex oil and gas reservoirs are mainly exploited through a horizontal well which has a large oil discharge area and a large controlled reserve. The horizontal well is a special well that has a maximum well inclination angle of being at or near 90° (generally not less than) 86° and maintains a certain length of horizontal well segment in a target geological layer where the oil and/or gas are/is stored. The longer the horizontal well segment in contact with the target geological layer in the horizontal well, the higher the oil and gas reservoir exploitation efficiency of the horizontal well. During a drilling process of a complex oil and gas reservoir horizontal well which is used as a target well, a reservoir penetration rate of the target geological layer directly determines a subsequent oil and gas reservoir exploitation efficiency of the target well. Therefore, during the drilling process of the target well, only based on an accurate geosteering can it be ensured that a high reservoir penetration rate is reached during the drilling process, especially the reservoir penetration rate of the horizontal well segment.

Figure 1:
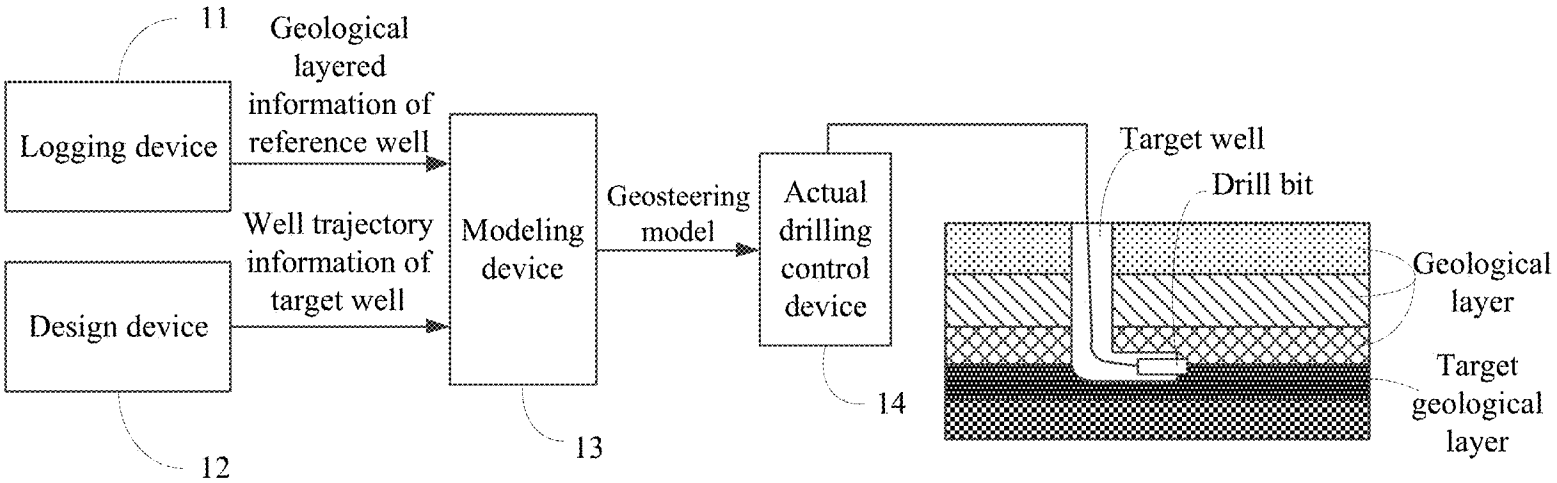
FIG. 1 (Prior art)
FIG. 1 is an architectural diagram of an existing geosteering system.

At present, the architecture of a geosteering system of the target well is as shown in FIG. 1, and the specific geosteering process is as follows: a modeling device 13 acquires geological information of a reference well from a logging device 11, and acquires from a design device 12 designed well trajectory information designed for the target well in advance. The geological information of the reference well includes, for example, a reference well trajectory, a logging curve, and stratification data including a geological attribute of each geological layer and a geological layer interface coordinate. The modeling device 13 draws, based on the geological information of the reference well and with a plane where a designed well trajectory of the target well is located as a steering profile, a geological structure line of each geological layer in an designed well trajectory region of the target well on the steering profile, so as to form a steering profile map of the target well. The geological structure line is an intersection line between an interface of the geological layer and the steering profile. The steering profile map is a geosteering model of the target well. The modeling device 13 uses the geosteering model to perform the following geosteering on an actual drilling of the target well: the modeling device 13 acquires logging-while-drilling information of the target well from the logging device 11 during the actual drilling process of the target well, and performs, in conjunction with the geosteering model of the target well, an actual drilling analysis and real-time adjustment of the designed well trajectory, so as to obtain an adjusted well trajectory. The modeling device 13 will send the adjusted well trajectory to an actual drilling control device 14 in real time, so that the actual drilling control device 14 can control the drilling of a drill bit based on the adjusted well trajectory.

Since the complex oil and gas reservoirs have the characteristic of rapid geological structural change, the existing modeling methods establish the geosteering model of the target well based only on the geological information of the reference well, and there is a large difference between the established geosteering model and a layered structure condition of a true geological layer in a target well region. The large difference between the geosteering model and the structure of the true geological layer in the target well region leads to inaccurate geosteering of the target well during the actual drilling process, resulting in the condition that the horizontal well segment of the horizontal well is out of layer during the actual drilling process of the target well, thereby further resulting in a low reservoir penetration rate of the horizontal well and seriously restricting the subsequent oil and gas reservoir collection efficiency of the horizontal well.

In this regard, the present application provides a geosteering method, which establishes an accurate geosteering model for the target well by combining the geological information of the reference well with geological research data of the target well region, so as to solve the problem in the prior art that the geosteering model of the target well established merely based on the geological information of the reference well is not accurate, which in turn causes the problem of inaccurate steering of the existing geosteering methods. The geological research data refers to geological structural data of a first designated geological attribute of the target well region obtained through seismic inversion and geological sedimentary facies research and analysis.

The geosteering method proposed in the present application will be described below with reference to some embodiments.

Figure 2:
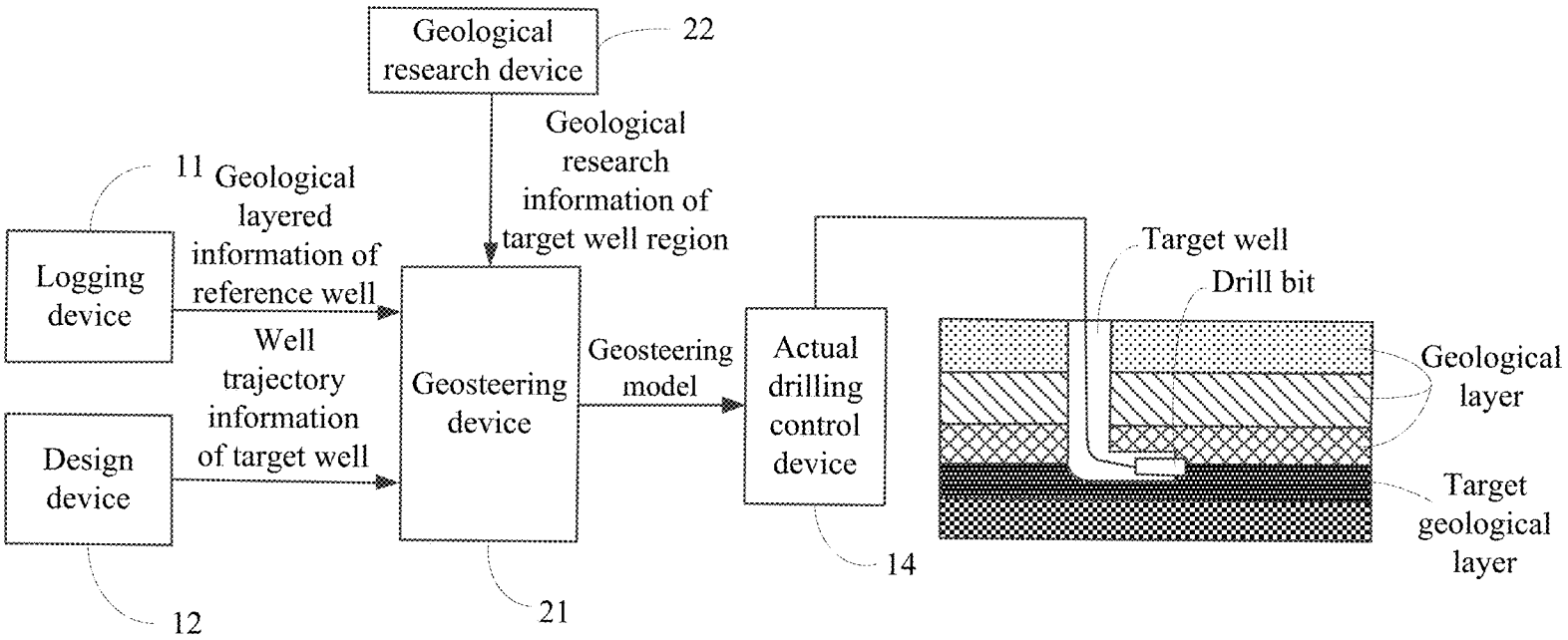
FIG. 2 is an architectural diagram of a geosteering system according to an embodiment of the present application.

FIG. 2 is an architecture diagram of a geosteering system according to an embodiment of the present application. As shown in FIG. 2, a geosteering device 21 acquires geological research information of the target well region from a geological research device 22. The geosteering device 21 acquires the geological information of the reference well from the logging device 11. The geosteering device 21 acquires first well trajectory information of the target well from a design device 12. For example, a first well trajectory is a wellbore trajectory designed in advance for the target well based on the geological information of the reference well after the design device 12 acquires the geological information of the reference well from the logging device 11, that is, the first well trajectory is the designed well trajectory of the target well. The geological research device 22 refers to a device that can conduct experimental researches on geology, such as a seismic inversion device, a sedimentary facies experimental research device, etc., and it is not specifically limited in this embodiment. The geological research information of the target well region refers to the geological information obtained after performing the experimental researches, such as seismic inversion and sedimentary facies experiment, on the geology of the first designated geological attribute of a region corresponding to the first well trajectory of the target well by the geological research device 22, and includes interface coordinate information of the geological layer of at least one geologic attribute. The geological information of the reference well refers to layered information of the geological layer corresponding to the reference well obtained after performing a logging detection on the reference well of the target well by the logging device 11, and includes interface coordinate information of the geological layer corresponding to each geological attribute of the reference well. The geological research information of the target well region is also referred to as first geological information in the present application; and the geological information of the reference well is also referred to as second geological information in the present application.

The geosteering device 21 determines a geological structure line of a first class geological layer corresponding to the first geological information on the steering profile by using a plane where the first well trajectory of the target well is located as the steering profile. The geological structure line is an intersection line between an interface of the geological layer and the steering profile. The geosteering device 21 determines, by using the geological structure line of the first class geological layer as a reference and based on the second geological information, a geological structure line of a second class geological layer corresponding to the second geological information on the steering profile, so as to obtain the geosteering model of the target well. The second class geological layer refers to the geological layer with a geological attribute that is different from that of the first class geological layer. Therefore, the geosteering model of the target well obtained by the geosteering device 21 may include geological structure lines of geological layers of all geological attributes corresponding to the second geological information on the steering profile.

The geosteering device 21 uses the geosteering model to perform geosteering on actual drilling of the target well. For example, a process in which the geosteering device 21 uses the geosteering model to perform geosteering is as follows: the geosteering device 21 reviews and adjusts the first well trajectory before actual drilling to obtain a second well trajectory. The second well trajectory is a well trajectory of the horizontal well segments in contact with the target geological layer. The geosteering device 21 sends the second well trajectory to the actual drilling control device 14, so that the actual drilling control device 14 can control the drilling of the drill bit based on the second well trajectory. During the actual drilling process, the geosteering device 21 acquires the logging-while-drilling information of the target well from the logging device 11, performs actual drilling analysis in conjunction with the geosteering model of the target well determined by the geosteering device 21, and performs a real-time adjustment of the second well trajectory based on a result of the actual drilling analysis, so to obtain the adjusted well trajectory. The geosteering device 21 sends the adjusted well trajectory after the real-time adjustment to the actual drilling control device 14 in real time, so that the actual drilling control device 14 can control the drilling of the drill bit based on the adjusted well trajectory after the real-time adjustment.

In an embodiment, the geosteering device may also use the geosteering model to provide geosteering for other operations of the target well.

In the geosteering method provided in the present application, the geological structure line of the first class geological layer corresponding to the first geological information on the steering profile is determined by using the plane where the first well trajectory of the target well is located as the steering profile and based on the first geological information, and consequently the geological structure line of the geological layer of the first designated geological attribute in the region corresponding to the first well trajectory on the steering profile is determined. And then the geological structure line of the second class geological layer on the steering profile is determined by using the geological structure line of the first class geological layer as a reference and in conjunction with the second geological information, so as to form an accurate geosteering model of the target well. The accurate geosteering model is used to perform precise geosteering on the actual drilling of the target well so as to ensure that the target well has a high reservoir penetration rate. The geosteering method provided in the present application solves the problem of inaccurate steering in the existing geosteering methods, improves the reservoir penetration rate of the target geological layer during the actual drilling process of the target well, and ensures that the subsequent oil and gas reservoir exploitation efficiency of the target well meets the requirements.

Figure 3:
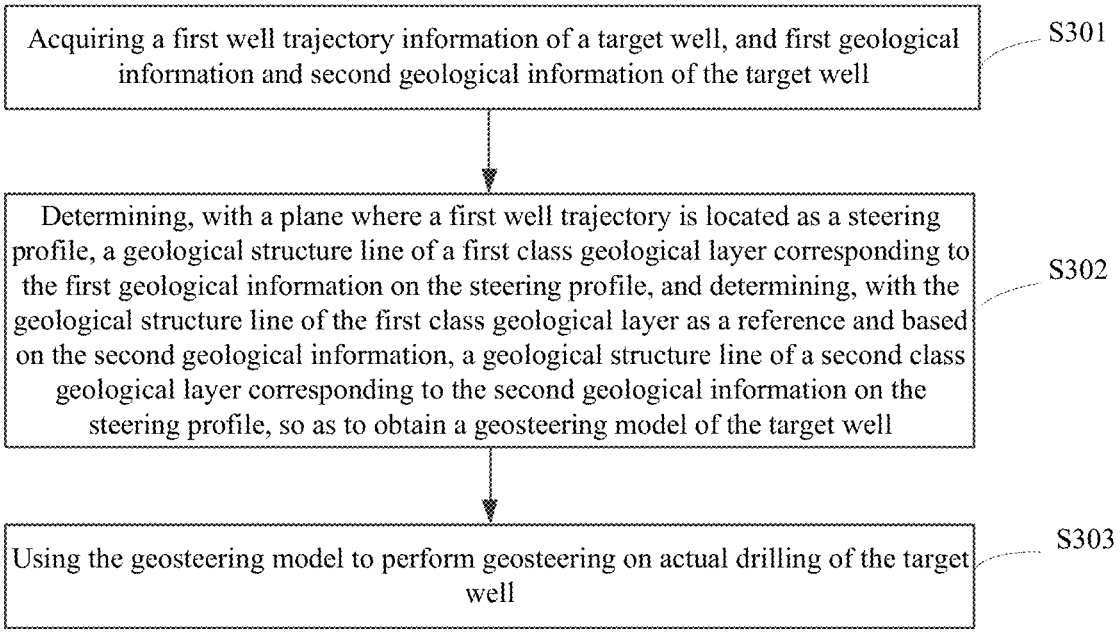
FIG. 3 is a geosteering flowchart according to an embodiment of the present application.

The geosteering method provided in the present application will be described below in detail with reference to the FIGS. 2-3. FIG. 3 is a geosteering flowchart according to an embodiment of the present application. The execution entity of the embodiment shown in FIG. 3 may be the geosteering device 21 in the embodiment shown in FIG. 2. As shown in FIG. 3, the method includes the following steps.

S301, acquiring the first well trajectory information of the target well, and the first geological information and the second geological information of the target well.

Specifically, the geosteering device 21 acquires the first well trajectory information of the target well, and the first and second geological information of the target well, where the first geological information is geological information obtained by investigating the geology of the first designated geological attribute in the region corresponding to the first well trajectory, the first geological information includes interface coordinate information of a geological layer of at least one geological attribute, and the second geological information includes interface coordinate information of a geological layer of each geological attribute of the reference well of the target well.

For example, the geosteering device 21 acquires the first well trajectory information of the target well from the design device 12 shown in FIG. 2, acquires the first geological information of the target well from the geological research device 22 shown in FIG. 2, and acquires the second geological information of the target well from the logging device 11 shown in FIG. 2.

In an embodiment, the first geological information may also be acquired by the geosteering device 21 in the following method: the geosteering device 21 acquires seismic inversion data and sedimentary facies related research data of a designated region of the target well from the geological research device 22, and the geosteering device 21 acquires a trajectory and logging and interpretation result of a drilled well within the designated region of the target well from the logging device 11. The geosteering device 21 performs a fusion processing on the acquired seismic data inversion, the sedimentary facies related research data and the trajectory and logging and interpretation result of the drilled well, so as to obtain the first geological information.

S302, determining, with a plane where the first well trajectory is located as the steering profile, the geological structure line of the first class geological layer corresponding to the first geological information on the steering profile, and determining, by using the geological structure line of the first class geological layer as a reference and based on the second geological information, the geological structure line of the second class geological layer corresponding to the second geological information on the steering profile, so as to obtain a geosteering model of the target well.

The geological structure line is an intersecting line between an interface of the geological layer and the steering profile, and the second class geological layer is a geological layers with a geological attribute that is different from that of the first class geological layer.

Specifically, the geosteering device 21 acquires the geosteering model of the target well according to steps S3021-S3022.

S3021, determining, by using the plane where the first well trajectory is located as the steering profile, the geological structure line of the first class geological layer corresponding to the first geological information on the steering profile.

Specifically, the geosteering device 21 determines, by using the plane where the first well trajectory is located as the steering profile, the geological structure line of the first class geological layer corresponding to the first geological information on the steering profile.

In an embodiment, the first geological information may be the geological information of the first designated geological attribute obtained through seismic inversion and/or sedimentary facies research. The geosteering device 21 determines the geological structure line of the first class geological layer corresponding to the first geological information on the steering profile according to steps (1) to (2) as follows:

(1) The geosteering device 21 creates the steering profile along the first well trajectory of the target well, where a length of the steering profile is not less than a true horizontal length (referred to as THL) of the first well trajectory, and a height of the steering profile is not less than a maximum value of a total thickness of the geological layer of a second designated geological attribute of the region corresponding to the first well trajectory. For example, the geological layer of the second designated geological attribute may be one geological layer or at least two geological layers. In an embodiment, if the geological layer of the second designated geological attribute is at least two geological layers, the maximum value of the total thickness of the geological layer of the second designated geological attribute may be a sum of maximum thicknesses of the at least two geological layers. For example, the thickness of the geological layer in the present application may be a true stratigraphic thickness (referred to as TST).

(2) The geosteering device 21 determines the geological structure line of the first class geological layer of the first designated geological attribute corresponding to the first geological information on the steering profile based on the first geological information.

By determining the geological structure line of the geological layer of the first designated geological attribute corresponding to the first geological information on the steering profile based on the first geological information, an accurate geological layer structure information of the geological layer of the first designated geological attribute in the target well region is determined, thereby improving a matching degree between the geosteering model of the target well and a layered structure of a true geological layer in the target well region, and improving an accuracy of subsequently established geosteering model of the target well.

In an embodiment, if the first well trajectory intersects with a geological fault, the geosteering device 21 segments the first well trajectory by using an intersection point between the first well trajectory and the geological fault as a segmentation node, to obtain first well trajectory segments. The geosteering device 21 determines, with a plane where the first well trajectory segments are located as the steering profile and based on the first geological information corresponding to the first well trajectory segments, the geological structure line of the first class geological layer corresponding to the first geological information corresponding to the first well trajectory segments on the steering profile corresponding to the first well trajectory segments.

Since the geological fault disrupts a distribution continuity of the geological layer in a direction parallel to an earth surface, segmenting the first well trajectory of the target well by using the intersection point between the first well trajectory and the geological fault as the segmentation node and then determining the geological structure line of the geological layer corresponding to the first geological information of each first well trajectory segment based on the first geological information corresponding to each first well trajectory segment may improve the accuracy of the geosteering model of the target well.

S3022, determining, by using the geological structure line of the first class geological layer as a reference and based on the second geological information, the geological structure line of the second class geological layer corresponding to the second geological information on the steering profile, so as to obtain the geosteering model of the target well.

Specifically, the geosteering device 21 determines, by using the geological structure line of the first class geological layer as a reference and based on the second geological information, the geological structure line of the second class geological layer corresponding to the second geological information on the steering profile, so as to obtain the geosteering model of the target well.

For example, the geosteering device 21 determines, based on an arrangement order of the second class geological layer in the second geological information and using the geological structure line of the first class geological layer as a reference, the geological structure line of the second class geological layer that is co-interfaced with the first class geological layer, in a manner that is equal in thickness to the second class geological layer in the second geological information. The geosteering device 21 determines the geological structure line of the second class geological layer that is not co-interfaced with the first class geological layer, according to the arrangement order of the second class geological layer in the second geological information and in a manner of equal thickness ratio.

Since the first geological information is accurate geological information obtained through experimental research on the first geological layer of the first designated geological attribute of the target well region and the geological layer has the characteristic of continuous distribution, the geological structure line of the second class geological layer is determined by using the geological structure line of the first class geological layer as a reference and in conjunction with the second geological information, so as to acquire the geosteering model of the target well. The geosteering model established in the method of the present application is based on the geological structure line that is determined by true and accurate information of the first class geological layer in the target well region, and comprehensively considers continuous distribution characteristic of the second class geological layer, improving the accuracy of the geosteering model and ensuring a high reservoir penetration rate of the subsequent target well.

In an embodiment, the reference well of the target well is determined as follows:

If the number of an adjacent well adjacent to the target well in a designated region is less than or equal to one, the geosteering device 21 determines the adjacent well and/or a pilot well of the target well as the reference well.

If the number of the adjacent well adjacent to the target well in the designated region is greater than one and there is a geological fault between the adjacent wells, the geosteering device 21 segments the first well trajectory of the target well by using an intersection point between the geological fault or a plane where the geological fault is located and the first well trajectory as a segmentation node, to obtain first well trajectory segments. The geosteering device 21 determines the adjacent well located on the same side of the geological fault as each of the first well trajectory segments as the reference well of each of the first well trajectory segments. For example, if the first well trajectory passes through the geological fault, the geosteering device 21 takes the intersection point between the first well trajectory and the geological fault as the segmentation node. If the first well trajectory does not pass through the geological fault, the geosteering device 21 takes the intersection point between the plane where the geological fault is located and the first well trajectory as the segmentation node. If there is no intersection point between the first well trajectory and the plane where the geological fault is located, it indicates that the first well trajectory is at one side of the geological fault, and the geosteering device 21 determines the adjacent well on the same side of the geological fault as the first well trajectory as the reference well of the first well trajectory. Since the geological fault disrupts the distribution continuity of the geological layer, segmenting the first well trajectory of the target well by using the intersection point between the geological fault or the plane where the geological fault is located and the first well trajectory as the segmentation node and then determining the geological structure line of the geological layer corresponding to each first well trajectory segment based on the geological information of the reference well of each first well trajectory segment after segmentation processing, may improve the accuracy of the geosteering model of the target well.

If the number of the adjacent well adjacent to the target well in the designated region is greater than one and there is no geological fault between the adjacent wells, the geosteering device 21 segments the first well trajectory by using an intersection point between a perpendicular line of the first well trajectory from the adjacent well to the target well and the first well trajectory as the segmentation node so as to obtain the first well trajectory segments. The geosteering device 21 determines the adjacent well corresponding to the segmentation node on the first well trajectory segments as the reference well. For example, the geosteering device 21 determines that the adjacent well corresponding to the segmentation node on the first well trajectory segment as the reference well of the first well trajectory segment. Determining the geological structure line of the geological layer corresponding to each first well trajectory segment by taking the adjacent well corresponding to the segmentation node on each first well trajectory segment as the reference well, can further improve the accuracy of the geosteering model of the target well.

Furthermore, after determining the adjacent well corresponding to the segmentation node on each first well trajectory segment as the reference well, the method provided in the present application further includes the following steps I-III:

I. If there are two segmentation nodes on the first well trajectory segment, the geosteering device 21 divides the first well trajectory segments into two node sub-segments and one transition sub-segment according to a pre-set threshold value. The node sub-segment is a sub-segment including the segmentation node, and the transition sub-segment is a sub-segment connected to the two node sub-segments respectively.

II. The geosteering device 21 determines, by using the geological structure line corresponding to the first geological information as a reference and based on the second geological information using the adjacent well corresponding to the segmentation node on the node sub-segment as the reference well, the geological structure line of the second class geological layer corresponding to the node sub-segment.

III. The geological directional device 21 performs a smooth processing on information of the geological structure line of each node sub-segment corresponding to the transition sub-segment so as to obtain the geological structure line of the second class geological layer corresponding to the transition sub-segment.

In the absence of the geological fault, the geological layer is generally continuous in the direction parallel to the earth surface, and the change of the geological layer is generally smooth. Therefore, if there are two segmentation nodes on the first well trajectory segments, determining the geological structure line of the second class geological layer corresponding to the sub-segments according to steps II-III after the first well trajectory segments are divided into two node sub-segments and one transition sub-segment according to the pre-set threshold value, may improve the matching degree between the geosteering model of the target well and the layered structure condition of the true geological layer of the first well trajectory region of the target well.

S303, using the geosteering model to perform geosteering on the actual drilling of the target well.

Specifically, the geosteering device 21 uses the geosteering model to perform geosteering on the actual drilling of the target well.

In an embodiment, the geosteering device 21 uses the geosteering model determined in step S302 to review and adjust the first well trajectory, to obtain the second well trajectory. All horizontal well segments of the second well trajectory are in contact with the target geological layer, e.g., the horizontal well segments of the second well trajectory are located in the target geological layer. The geosteering device 21 performs geosteering on the actual drilling of the target well based on the geosteering model and the second well trajectory.

For example, before actual drilling, the geosteering device 21 uses the geosteering model of the target well determined thereby to review and adjust the first well trajectory, so as to obtain the second well trajectory where the horizontal well segment of the well trajectory is located in the target geological layer. The geosteering device 21 sends the second well trajectory to the actual drilling control device 14 so that the actual drilling control device 14 controls the drill bit to drill along the second well trajectory based on the second well trajectory. During the actual drilling process, the geosteering device 21 acquires the logging-while-drilling information of the target well from the logging device 11 and performs actual drilling analysis and real-time adjustment of the second well trajectory in conjunction with the geosteering model of the target well determined by the geosteering device 21, so as to obtain the adjusted well trajectory. The geosteering device 21 sends the adjusted well trajectory after the real-time adjustment to the actual drilling control device 14 in real time, so that the actual drilling control device 14 can control the drilling of the drill bit based on the adjusted well trajectory after the real-time adjustment. Alternatively, the geosteering device 21 converts the second well trajectory or the adjusted well trajectory into drilling coordinate information, and sends the drilling coordinate information to the actual drilling control device 14. The actual drilling control device 14 sends a drilling instruction to the drill bit based on the received drilling coordinate information, so as to control the drill bit to drill according to a well trajectory corresponding to the drilling instruction, thereby ensuring that the target well has a high reservoir penetration rate.

Figure 4:
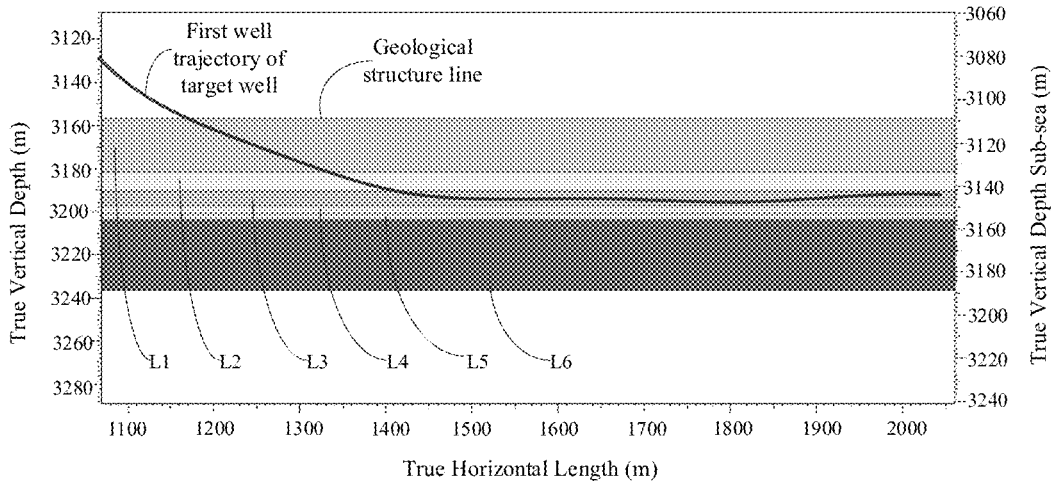
FIG. 4 is a comparison diagram of a geosteering model according to an embodiment of the present application.
Figure 4:
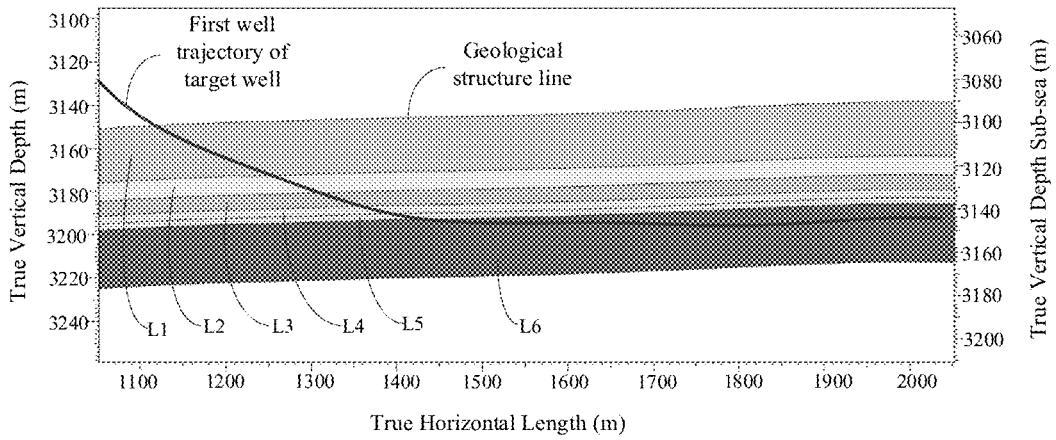
Figure 5:
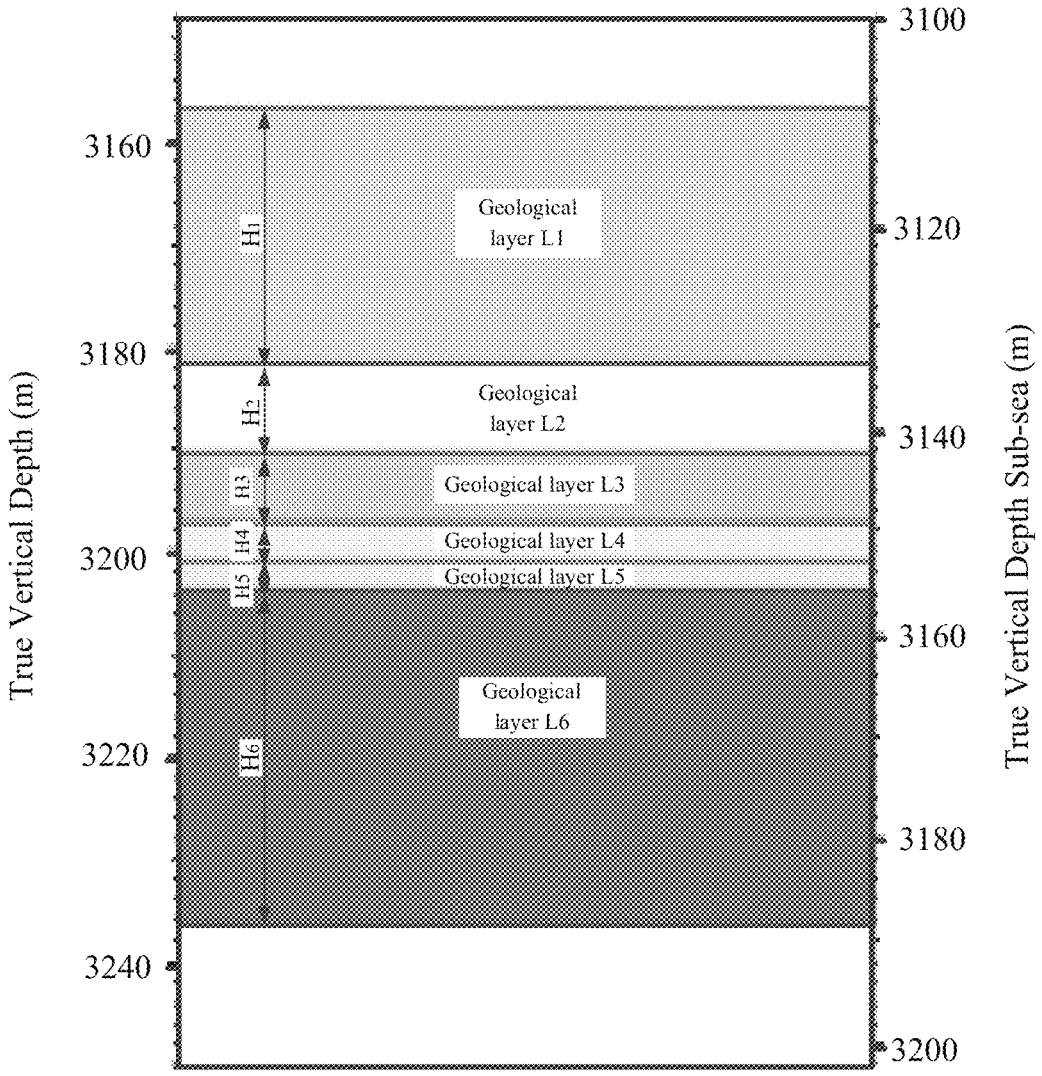
FIG. 5 shows an arrangement order and depth information of various geological layers of a reference well YS-2HP according to an embodiment of the present application.

In the below, with reference to FIG. 1, FIG. 2, FIG. 4 and FIG. 5, a specific embodiment is used to compare and explain the accuracy of geosteering models corresponding to the existing geosteering methods and the geosteering method provided in the present application respectively. FIG. 4 is a comparison diagram of the geosteering model according to an embodiment of the present application. In FIG. 4, 4*a* represents a geosteering model used in existing geosteering methods, and 4*b* represents a geosteering model used in the geosteering method provided in the present application. FIG. 5 shows an arrangement order and depth information of geological layers of a reference well YS-2HP according to an embodiment of the present application.

It is assumed that the target well is identified as YS-2H, the target geological layer thereof is the geological layer identified as L3, and the adjacent well is identified as YS-2HP. Both the modeling device 13 and the geosteering device 21 determine the adjacent well YS-2HP as the reference well of the target well YS-2H.

In FIG. 4, 4*a* shows the geosteering model of the target well YS-2H established based on the arrangement order and the interface coordinate information of the geological layers of the geological attributes in the geological information of the reference well YS-2HP after the modeling device 13 acquires the geological information of the reference well YS-2HP from the logging device 11. The geological information of the adjacent well YS-2HP is the second geological information of the target well YS-2H. The first well trajectory of the target well in FIG. 4 is a well trajectory designed for the target well YS-2H in advance by the design device 12 based on the oil and gas reservoir exploitation requirements and the geological information of the reference well YS-2HP obtained from the logging device 11. The modeling device 13 uses the geosteering model as shown in 4*a* of FIG. 4 to check the first well trajectory of the target well obtained from the design device 12, and the check result shows that all the horizontal well segments in the first well trajectory are in the target geological layer L3, and the first well trajectory has a high reservoir penetration rate. However, during the actual drilling process of the target well YS-2H, when the geosteering model shown in 4*a* of FIG. 4 was used to perform geosteering on the actual drilling of the target well YS-2H, the actual drilling analysis shows that after the target well encounters the target geological layer, a serious problem of out of layer occurs. After multiple adjustments are made to the first well trajectory, drilling along the adjusted well trajectory still fails to encounter the target geological layer, which indicates that the geosteering model shown in 4*a* of FIG. 4 is inaccurate.

However, after using the method provided in the present application for performing geosteering on the actual drilling of the target well YS-2H, the reservoir penetration rate of the target well is significantly improved. A specific process of using the method provided in the present application to perform geosteering on the actual drilling of the target well YS-2H is as shown in (a)-(e) below:

(a) The geosteering device 21 acquires the geological information of the reference well YS-2HP from the logging device 11, the first well trajectory of the target well from the design device 12, and a geological attribute of the geological layer L5 in a first well trajectory region and coordinate information of a top interface $L5_{top}$ and a bottom interface $L5_{bot}$ of the geological layer L5 from the geological research device 22, respectively. The geosteering device 21 performs information extraction processing on the acquired geological information of the reference well YS-2HP (i.e., second geological information), so as to obtain an arrangement order and depth information of geological layers in the second geological information. The arrangement order and the depth information of the geological layers in the second geological information are as shown in FIG. 5. FIG. 5 also shows true stratigraphic thicknesses H1, H2, H3, H4, H5, H6 of the geological layers L1, L2, L3, L4, L5, L6, respectively.

(b) The geosteering device 21 determines, by using the plane where the first well trajectory of the target well YS-2H is located as the steering profile and based on the coordinate information of the top interface $L5_{top}$ and the bottom interface $L5_{bot}$ obtained from the geological research device 22, the geological structure line of the geological layer L5 on the steering profile. The geological structure line of the geological layer L5 on the steering profile is upper and lower boundary lines of the geological layer L5 as shown in 4*b* of FIG. 4.

(c) It can be known from the second geological information shown in FIG. 5, the arrangement order of the geological layers is L1-L2-L3-L4-L5-L6. The top interface $L5_{top}$ of the geological layer L5 is co-interfaced with the bottom interface of the geological layer L4, and the bottom interface $L5_{bot}$ of the geological layer L5 is co-interfaced with the top interface of the geological layer L6. The geosteering device 21 determines, by using the geological structure line corresponding to the top interface $L5_{top}$ of the geological layer L5 as a reference, the geological structure line of the geological layer L4 co-interfaced with the L5 on the steering profile in a manner that is equal in thickness to the geological layer L4 in the second geological information. Specifically, the geosteering device 21 determines the geological structure line of the top interface of the geological layer L4 by taking the geological structure line corresponding to $L5_{top}$ as the geological structure line of the bottom interface of the geological layer L4 and taking the thickness H4 of the geological layer L4 in the second geological information as a thickness, so as to ensure that the thickness of the geological layer L4 in the geosteering model established by the geosteering device 21 as shown in 4*b* of FIG. 4 is equal to the thickness of the geological layer L4 in the second geological information. Similarly, the geosteering device 21 determines the geological structure line of the bottom interface of the geological layer L6 by taking the geological structure line corresponding to $L5_{bot}$ as the geological structure line of the top interface of the geological layer L6 and taking the thickness H6 of the geological layer L6 in the second geological information as a thickness.

(d) For other geological layers such as L1, L2, and L3 that are not co-interfaced with the geological layer L5, the geosteering device 21 determines the geological structure lines of the L1, L2 and L3 on the steering profile according to the arrangement order of the geological layers L1, L2 and L3 in the second geological information and in a manner of equal thickness ratio thereto. Specifically, since the bottom interface of L3 is co-interfaced with the top interface of L4 and the top interface of L1 is closest to the earth surface, a coordinate of the top interface of L1 may be directly measured by the geological research device 22. The geosteering device 21 takes the geological structure line of the top interface of L4 as the geological structure line of the bottom interface of L3. The geosteering device 21 determines the geological structure line of the top interface of L1 based on the coordinate of the top interface of L1. The geosteering device 21 determines, by using the geological structure line of the top interface of L1 and the geological structure line of the bottom interface of L3 as a reference, the geological structure lines corresponding to the bottom interface of L1, the top and bottom interfaces of L2, and the top interface of L3 respectively according to the thickness ratio of L1, L2, and L3 in the second geological information (i.e., H1:H2:H3). At this point, the geosteering device 21 completes the establishment of the geosteering model of the target well YS-2H, and the geosteering model of the target well YS-2H as shown in 4*b* of FIG. 4 has been established.

(e) The geosteering device 21 uses the geosteering model shown in 4*b* of FIG. 4 to check the first well trajectory of the target well YS-2H, and a check result shows that most of the horizontal well segments of the first well trajectory are located in the geological layer L6, that is, most of the horizontal well segments have been out of layer, and only a few of the well segments are located in the target geological layer L3. Based on the check result, the first well trajectory of the target well YS-2H is adjusted to obtain the second well trajectory. The geosteering device 21 sends the second well trajectory to the actual drilling control device 14 so that the actual drilling control device 14 controls the drill bit to drill along the second well trajectory based on the second well trajectory. After the actual drilling is started, the geosteering device 21 acquires the logging-while-drilling information of the target well in real time from the logging device 11, performs the actual drilling analysis in conjunction with the geosteering model, and performs the real-time adjustment of the second well trajectory based on the results of the actual drilling analysis, so to obtain the adjusted well trajectory. The geosteering device 21 sends the real-time adjusted well trajectory to the actual drilling control device 14 in real time, so that the actual drilling control device 14 can control the drilling of the drill bit based on the real-time adjusted well trajectory.

After the geosteering device 21 uses the geosteering model shown in 4*b* of FIG. 4 to perform geosteering on the actual drilling of the target well YS-2H, the reservoir penetration rate of the target well YS-2H during the actual drilling process is significantly improved, which indicates that the geosteering method provided in the present application has a high steering accuracy.

In the geosteering method provided in the present application, the geological structure line of the first class geological layer corresponding to the first geological information on the steering profile is determined by using the plane where the first well trajectory of the target well is located as the steering profile and based on the first geological information, and the geological structure lines of the second class geological layer that are and are not co-interfaced with the first class geological layer are respectively determined in a manner of equal thickness and equal thickness ratio by taking the geological structure line of the first class geological layer as a reference and combining with the arrangement order and thickness information of the second class geological layer with different geological attribute from the first class geological layer in the second geological information, so as to form an accurate geosteering model of the target well. And the geosteering model is used to perform accurate geosteering on the actual drilling of the target well. In the geosteering method provided in the present application, the geological structure line of the second class geological layer is determined by using the geological structure line determined by the precise geological information of the first class geological layer as a reference after the continuous distribution characteristic of the second class geological layer is comprehensively considered, so as to obtain an accurate geosteering model, thereby ensuring the accuracy of the geosteering, and effectively ensuring the high reservoir penetration rate of subsequent target well and greatly improving the subsequent oil and gas reservoir exploitation efficiency of the target well.

Figure 6:
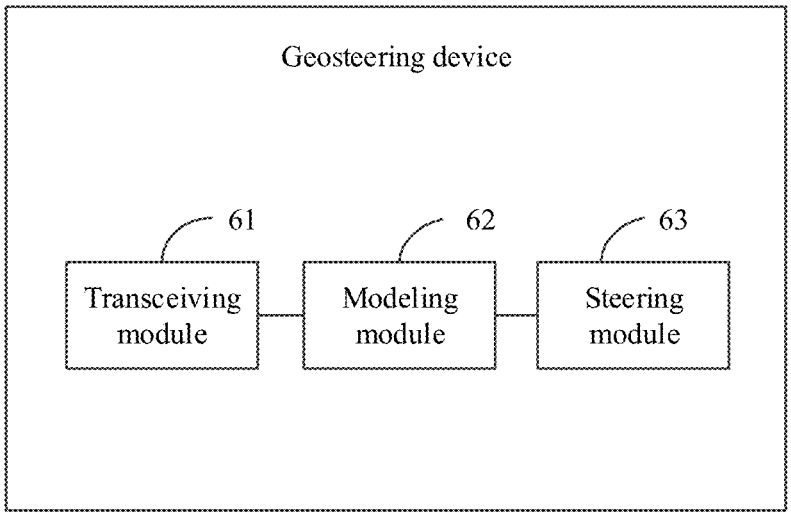
FIG. 6 is a structural diagram of a geosteering device according to an embodiment of the present application.

The embodiments of the present application further provide a geosteering modeling device. FIG. 6 is a structural diagram of the geosteering device according to an embodiment of the present application. As shown in FIG. 6, the device includes a transceiving module 61, a modeling module 62, and a steering module 63.

The transceiving module 61 is configured to acquire first well trajectory information of a target well, and first geological information and second geological information of the target well. The first geological information is geological information obtained by investigating a geology of a first designated geological attribute in a region corresponding to the first well trajectory The first geological information includes interface coordinate information of a geological layer of at least one geological attribute. The second geological information includes interface coordinate information of geological layers of geological attributes of the reference well of the target well.

The modeling module 62 is configured to determine, by using a plane where the first well trajectory is located as a steering profile, a geological structure line of a first class geological layer corresponding to first geological information on the steering profile, and to determine, by using the geological structure line of the first class geological layer as a reference and based on the second geological information, a geological structure line of the second class geological layer corresponding to the second geological information on the steering profile, so as to obtain the geosteering model of the target well. The geological structure line is an intersection line between an interface of the geological layer and the steering profile. The second class geological layer refers to a geological layer with a geological attribute that is different from that of the first class geological layer.

The steering module 63 is configured to use the geosteering model to perform geosteering on actual drilling of the target well.

The specific implementation principle and technical effect of the geosteering modeling device provided in the embodiments of the present application are similar to the implementation principle and technical effect of the embodiment shown in FIG. 3, and are not described in this embodiment again.

Figure 7:
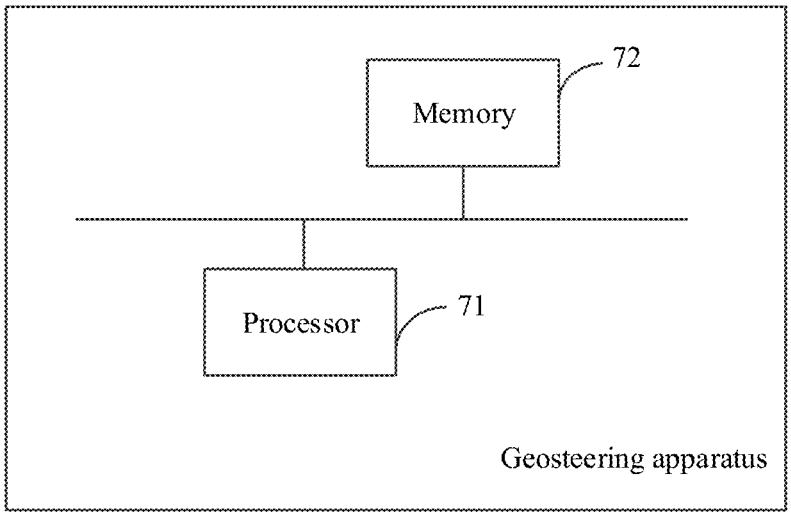
FIG. 7 is a structural diagram of a geosteering apparatus according to an embodiment of the present application.

An embodiment of the present application further provides a geosteering modeling apparatus. FIG. 7 is a structural diagram of a geosteering apparatus according to an embodiment of the present application. As shown in FIG. 7, the apparatus includes a processor 71 and a memory 72, where the memory 72 stores executable instructions that can be executed by the processor 71, so that the processor 71 can be used to execute the technical solutions of the foregoing method embodiments, and the implementation principle and technical effect thereof are similar to the method embodiments, and are not described in this embodiment again. It should be understood that the processor 71 may be a central processing unit (referred to as CPU), and may also be other general-purpose processor, a digital signal processor (referred to as DSP), an application specific integrated circuit (referred to as ASIC), etc. The general-purpose processor may be a microprocessor or any conventional processor. The steps of the method disclosed in the present disclosure may be directly implemented by a hardware processor or implemented by a combination of hardware and software modules in the processor. The memory 72 may include a high-speed random access memory (referred to as RAM), and may also include a non-volatile memory (referred to as NVM), such as at least one disk memory, and may also be a USB (Universal Serial Bus) disk, a mobile hard disk, a read-only memory, a magnetic disk, or an optical disk.

An embodiment of the present application further provides a storage medium, where the storage medium stores computer-executable instructions, which, when executed by a processor, implements the foregoing geosteering method. The storage medium may be implemented by any type of volatile storage device, non-volatile storage device or combination thereof, such as a static random-access memory (referred to as SRAM), an electrically-erasable programmable read-only memory (referred to as EEPROM), an erasable programmable read-only memory (referred to as EPROM), a programmable read-only memory (referred to as PROM), a read-only memory (referred to as ROM), a magnetic memory, a flash memory, a magnetic disk, or an optical disk. The storage medium may be any available media that can be accessed by a general-purpose computer or a special-purpose computer.

An exemplary storage medium is coupled to the processor so that the processor can read information from and write information to the storage medium. Of course, the storage medium may also be a component of the processor, and the processor and the storage medium may be located in an application specific integrated circuit (referred to as ASIC). Of course, the processor and the storage medium may also exist in an electronic device or a main control device as discrete components.

An embodiment of the present application further provides a program product, such as a computer program, where the computer program implements the geosteering method of the present application when being executed by the processor.

Those ordinary skilled in the art may understand that all or part of the steps of the method embodiments above may be completed through the hardware related to the program instructions. The foregoing program may be stored in a computer-readable storage medium. When the program is executed, the steps of the foregoing method embodiments are executed. The foregoing storage medium includes any medium that is capable of storing program codes, such as a ROM, a RAM, a magnetic disk, or an optical disk.

Finally, it should be noted that the foregoing embodiments are merely used to illustrate, but not to limit, the technical solutions of the present disclosure. Although the present disclosure has been described in detail with reference to the foregoing embodiments, those skilled in the art should understand that they may still make modifications to the technical solutions described in the foregoing embodiments, or make equivalent replacements to some or all technical features therein. However, these modifications or replacements do not make the essence of the corresponding technical solutions deviate from the scope of the technical solutions of the embodiments of the present disclosure.

What is claimed is:

1. A geosteering method, comprising:

acquiring first well trajectory information of a target well, and first geological information and second geological information of the target well, wherein the first geological information is geological information obtained by investigating a geology of a first designated geological attribute in a region corresponding to a first well trajectory, the first geological information comprises interface coordinate information of geological layer of at least one geological attribute, and the second geological information comprises interface coordinate information of geological layers of geological attributes of a reference well of the target well;

determining, by using a plane where the first well trajectory is located as a steering profile, a geological structure line of a first class geological layer corresponding to the first geological information on the steering profile, and determining, by using the geological structure line of the first class geological layer as a reference and based on the second geological information, a geological structure line of a second class geological layer corresponding to the second geological information on the steering profile, so as to obtain a geosteering model of the target well, wherein the geological structure lines are intersecting lines between interfaces of the geological layers and the steering profile, and the second class geological layer is a geological layer with a geological attribute that is different from that of the first class geological layer; and using the geosteering model to perform geosteering on actual drilling of the target well.

2. The method according to claim 1, wherein the first geological information is geological information of the first designated geological attribute obtained through seismic inversion and/or sedimentary facies research; and the determining, by using the plane where the first well trajectory is located as the steering profile, the geological structure line of the first class geological layer corresponding to the first geological information on the steering profile, comprises:

creating the steering profile along the first well trajectory, wherein a length of the steering profile is not less than a true horizontal length of the first well trajectory, and a height of the steering profile is not less than a maximum value of a total thickness of geological layers of a second designated geological attribute in the region corresponding to the first well trajectory; and determining the geological structure line of the first class geological layer corresponding to the first geological information of the first designated geological attribute on the steering profile.

3. The method according to claim 1, wherein the determining, by using the geological structure line of the first class geological layer as a reference and based on the second geological information, the geological structure line of the second class geological layer corresponding to the second geological information on the steering profile, comprises:

determining, based on an arrangement order of the second class geological layer in the second geological information and using the geological structure line of the first class geological layer as a reference, the geological structure line of the second class geological layer that is co-interfaced with the first class geological layer in a manner of equal in thickness to the second class geological layer in the second geological information; and determining the geological structure line of the second class geological layer that is not co-interfaced with the first class geological layer according to the arrangement order of the second class geological layer in the second geological information and in a manner of equal in thickness ratio to the second class geological layer in the second geological information.

4. The method according to claim 1, wherein the using the geosteering model to perform geosteering on actual drilling of the target well, comprises:

reviewing and adjusting the first well trajectory by the geosteering model so as to obtain a second well trajectory, wherein all horizontal well segments of the second well trajectory are in contact with a target geological layer; and performing geosteering on actual drilling of the target well based on the geosteering model and the second well trajectory.

5. The method according to claim 1, wherein the reference well of the target well is determined as follows:

if the number of an adjacent well adjacent to the target well in a designated region is less than or equal to one, determining the adjacent well and/or a pilot well of the target well as the reference well;

if the number of the adjacent well adjacent to the target well in the designated region is greater than one and there is a geological fault between the adjacent wells, segmenting the first well trajectory by using an intersection point between the geological fault or a plane where the geological fault is located and the first well trajectory as a segmentation node so as to obtain first well trajectory segments; and determining the adjacent well located on the same side of the geological fault as each of the first well trajectory segments as the reference well of each of the first well trajectory segments; and if the number of the adjacent well adjacent to the target well in the designated region is greater than one and there is no geological fault between the adjacent wells, segmenting the first well trajectory by using an intersection point between a perpendicular line from the adjacent well to the first well trajectory and the first well trajectory as the segmentation node so as to obtain the first well trajectory segments; and determining the adjacent well corresponding to the segmentation node on the first well trajectory segments as the reference well.

6. The method according to claim 2, wherein the reference well of the target well is determined as follows:

if the number of an adjacent well adjacent to the target well in a designated region is less than or equal to one, determining the adjacent well and/or a pilot well of the target well as the reference well;

if the number of the adjacent well adjacent to the target well in the designated region is greater than one and there is a geological fault between the adjacent wells, segmenting the first well trajectory by using an intersection point between the geological fault or a plane where the geological fault is located and the first well trajectory as a segmentation node so as to obtain first well trajectory segments; and determining the adjacent well located on the same side of the geological fault as each of the first well trajectory segments as the reference well of each of the first well trajectory segments; and if the number of the adjacent well adjacent to the target well in the designated region is greater than one and there is no geological fault between the adjacent wells, segmenting the first well trajectory by using an intersection point between a perpendicular line from the adjacent well to the first well trajectory and the first well trajectory as the segmentation node so as to obtain the first well trajectory segments; and determining the adjacent well corresponding to the segmentation node on the first well trajectory segments as the reference well.

7. The method according to claim 3, wherein the reference well of the target well is determined as follows:

if the number of an adjacent well adjacent to the target well in a designated region is less than or equal to one, determining the adjacent well and/or a pilot well of the target well as the reference well;

if the number of the adjacent well adjacent to the target well in the designated region is greater than one and there is a geological fault between the adjacent wells, segmenting the first well trajectory by using an intersection point between the geological fault or a plane where the geological fault is located and the first well trajectory as a segmentation node so as to obtain first well trajectory segments; and determining the adjacent well located on the same side of the geological fault as each of the first well trajectory segments as the reference well of each of the first well trajectory segments; and if the number of the adjacent well adjacent to the target well in the designated region is greater than one and there is no geological fault between the adjacent wells, segmenting the first well trajectory by using an intersection point between a perpendicular line from the adjacent well to the first well trajectory and the first well trajectory as the segmentation node so as to obtain the first well trajectory segments; and determining the adjacent well corresponding to the segmentation node on the first well trajectory segments as the reference well.

8. The method according to claim 4, wherein the reference well of the target well is determined as follows:

if the number of an adjacent well adjacent to the target well in a designated region is less than or equal to one, determining the adjacent well and/or a pilot well of the target well as the reference well;

if the number of the adjacent well adjacent to the target well in the designated region is greater than one and there is a geological fault between the adjacent wells, segmenting the first well trajectory by using an intersection point between the geological fault or a plane where the geological fault is located and the first well trajectory as a segmentation node so as to obtain first well trajectory segments; and determining the adjacent well located on the same side of the geological fault as each of the first well trajectory segments as the reference well of each of the first well trajectory segments; and if the number of the adjacent well adjacent to the target well in the designated region is greater than one and there is no geological fault between the adjacent wells, segmenting the first well trajectory by using an intersection point between a perpendicular line from the adjacent well to the first well trajectory and the first well trajectory as the segmentation node so as to obtain the first well trajectory segments; and determining the adjacent well corresponding to the segmentation node on the first well trajectory segments as the reference well.

9. The method according to claim 5, wherein after determining the adjacent well corresponding to the segmentation node on the first well trajectory segments as the reference well, the method further comprises:

if there are two segmentation nodes on the first well trajectory segments, dividing the first well trajectory segments into two node sub-segments and one transition sub-segment according to a pre-set threshold value, wherein the node sub-segment is a sub-segment including the segmentation node, and the transition sub-segment is a sub-segment connected to the two node sub-segments respectively;

determining, by using the geological structure line corresponding to the first geological information as a reference and based on the second geological information that the adjacent well corresponding to the segmentation node on the node sub-segment is the reference well, the geological structure line of the second class geological layer corresponding to the node sub-segment; and performing a smooth processing on the geological structure lines of the node sub-segments corresponding to the transition sub-segment so as to obtain the geological structure line of the second class geological layer corresponding to the transition sub-segment.

10. The method according to claim 9, wherein the determining, by using the plane where the first well trajectory is located as the steering profile, the geological structure line of the first class geological layer corresponding to the first geological information on the steering profile, further comprises:

if the first well trajectory intersects with the geological fault, segmenting the first well trajectory by using the intersection point between the first well trajectory and the geological fault as the segmentation node so as to obtain the first well trajectory segments; and determining, by using the plane where the first well trajectory is located as the steering profile and based on the first geological information corresponding to the first well trajectory segment, the geological structure line of the first class geological layer corresponding to the first geological information corresponding to the first well trajectory segment on the steering profile corresponding to the first well trajectory segment.

11. A geosteering modeling apparatus, comprising:

a processor and a memory, wherein the memory stores executable instructions that are executable by the processor, and the processor executes the executable instructions stored in the memory, to enable the processor executes the method according to claim 1.

12. The geosteering modeling apparatus according to claim 11, wherein the first geological information is geological information of the first designated geological attribute obtained through seismic inversion and/or sedimentary facies research; and the determining, by using the plane where the first well trajectory is located as the steering profile, the geological structure line of the first class geological layer corresponding to the first geological information on the steering profile, comprises:

creating the steering profile along the first well trajectory, wherein a length of the steering profile is not less than a true horizontal length of the first well trajectory, and a height of the steering profile is not less than a maximum value of a total thickness of geological layers of a second designated geological attribute in the region corresponding to the first well trajectory; and determining the geological structure line of the first class geological layer corresponding to the first geological information of the first designated geological attribute on the steering profile.

13. The geosteering modeling apparatus according to claim 11, wherein the determining, by using the geological structure line of the first class geological layer as a reference and based on the second geological information, the geological structure line of the second class geological layer corresponding to the second geological information on the steering profile, comprises:

determining, based on an arrangement order of the second class geological layer in the second geological information and using the geological structure line of the first class geological layer as a reference, the geological structure line of the second class geological layer that is co-interfaced with the first class geological layer in a manner of equal in thickness to the second class geological layer in the second geological information; and determining the geological structure line of the second class geological layer that is not co-interfaced with the first class geological layer according to the arrangement order of the second class geological layer in the second geological information and in a manner of equal in thickness ratio to the second class geological layer in the second geological information.

14. The geosteering modeling apparatus according to claim 11, wherein the using the geosteering model to perform geosteering on actual drilling of the target well, comprises:

reviewing and adjusting the first well trajectory by the geosteering model so as to obtain a second well trajectory, wherein all horizontal well segments of the second well trajectory are in contact with a target geological layer; and performing geosteering on actual drilling of the target well based on the geosteering model and the second well trajectory.

15. The geosteering modeling apparatus according to claim 11, wherein the reference well of the target well is determined as follows:

if the number of an adjacent well adjacent to the target well in a designated region is less than or equal to one, determining the adjacent well and/or a pilot well of the target well as the reference well;

if the number of the adjacent well adjacent to the target well in the designated region is greater than one and there is a geological fault between the adjacent wells, segmenting the first well trajectory by using an intersection point between the geological fault or a plane where the geological fault is located and the first well trajectory as a segmentation node so as to obtain first well trajectory segments; and determining the adjacent well located on the same side of the geological fault as each of the first well trajectory segments as the reference well of each of the first well trajectory segments; and if the number of the adjacent well adjacent to the target well in the designated region is greater than one and there is no geological fault between the adjacent wells, segmenting the first well trajectory by using an intersection point between a perpendicular line from the adjacent well to the first well trajectory and the first well trajectory as the segmentation node so as to obtain the first well trajectory segments; and determining the adjacent well corresponding to the segmentation node on the first well trajectory segments as the reference well.

16. The geosteering modeling apparatus according to claim 15, wherein after determining the adjacent well corresponding to the segmentation node on the first well trajectory segments as the reference well, the method further comprises:

if there are two segmentation nodes on the first well trajectory segments, dividing the first well trajectory segments into two node sub-segments and one transition sub-segment according to a pre-set threshold value, wherein the node sub-segment is a sub-segment including the segmentation node, and the transition sub-segment is a sub-segment connected to the two node sub-segments respectively;

determining, by using the geological structure line corresponding to the first geological information as a reference and based on the second geological information that the adjacent well corresponding to the segmentation node on the node sub-segment is the reference well, the geological structure line of the second class geological layer corresponding to the node sub-segment; and performing a smooth processing on the geological structure lines of the node sub-segments corresponding to the transition sub-segment so as to obtain the geological structure line of the second class geological layer corresponding to the transition sub-segment.

17. The geosteering modeling apparatus according to claim 16, wherein the determining, by using the plane where the first well trajectory is located as the steering profile, the geological structure line of the first class geological layer corresponding to the first geological information on the steering profile, further comprises:

if the first well trajectory intersects with the geological fault, segmenting the first well trajectory by using the intersection point between the first well trajectory and the geological fault as the segmentation node so as to obtain the first well trajectory segments; and determining, by using the plane where the first well trajectory is located as the steering profile and based on the first geological information corresponding to the first well trajectory segment, the geological structure line of the first class geological layer corresponding to the first geological information corresponding to the first well trajectory segment on the steering profile corresponding to the first well trajectory segment.

18. A non-transitory storage medium, wherein the storage medium stores computer-executable instructions, which, when executed by a processor, are used to implement the method according to claim 1.

19. The non-transitory storage medium according to claim 18, wherein the first geological information is geological information of the first designated geological attribute obtained through seismic inversion and/or sedimentary facies research; and the determining, by using the plane where the first well trajectory is located as the steering profile, the geological structure line of the first class geological layer corresponding to the first geological information on the steering profile, comprises:

creating the steering profile along the first well trajectory, wherein a length of the steering profile is not less than a true horizontal length of the first well trajectory, and a height of the steering profile is not less than a maximum value of a total thickness of geological layers of a second designated geological attribute in the region corresponding to the first well trajectory; and determining the geological structure line of the first class geological layer corresponding to the first geological information of the first designated geological attribute on the steering profile.

* * * * *